US005626509A

United States Patent [19]

Hayashi

[11] Patent Number: 5,626,509

[45] Date of Patent: May 6, 1997

[54] SURFACE TREATMENT OF POLISHING CLOTH

[75] Inventor: Yoshihiro Hayashi, Tokyo, Japan

[73] Assignee: NEC Corporation, Tokyo, Japan

[21] Appl. No.: 395,310

[22] Filed: Feb. 28, 1995

[30] Foreign Application Priority Data

Mar. 16, 1994 [JP] Japan ..... 6-045826

[51] Int. Cl.[6] ..... B24B 29/00

[52] U.S. Cl. ..... 451/285; 451/56; 451/271; 451/443

[58] Field of Search ..... 451/56, 60, 270, 451/271, 283, 285, 287, 288, 397, 398, 443, 444, 446

[56] References Cited

U.S. PATENT DOCUMENTS

| | | | |
|---|---|---|---|
| 4,728,552 | 3/1988 | Jensen, Jr. | 428/91 |
| 5,036,630 | 8/1991 | Kaanta et al. | 51/283 |
| 5,081,051 | 1/1992 | Mattingly et al. | 451/56 |
| 5,216,843 | 6/1993 | Breivogel et al. | 451/56 |
| 5,291,693 | 3/1994 | Nguyen | 451/41 |
| 5,384,986 | 1/1995 | Hirose et al. | 451/444 |
| 5,421,768 | 6/1995 | Fujiwara et al. | 451/283 |
| 5,486,131 | 1/1996 | Cesna et al. | 451/56 |

FOREIGN PATENT DOCUMENTS

| | | | |
|---|---|---|---|
| 0304605 | 3/1989 | European Pat. Off. . | |
| 0638391 | 2/1995 | European Pat. Off. . | |
| 1140959 | 6/1989 | Japan | 451/60 |
| 475338 | 3/1992 | Japan . | |
| 5315308 | 11/1993 | Japan . | |
| 1319882 | 6/1973 | United Kingdom . | |
| 2063322 | 6/1981 | United Kingdom . | |

OTHER PUBLICATIONS

"Ecologically–Safe Ionized Water Treatment for Wafer Processing", H. Aoki et al., Symposium on VLSI Technology Digest of Technical Papers pp. 107–108, 1994.

"Novel Electrolysis–Ionized–Water Cleaning Technique for the Chemical–Mechanical Polishing (CMP) Process", H. Aoki et al., Symposium on VLSI Technology Digest of Tecnnical Papers pp. 79–80, 1994.

*Primary Examiner*—Eileen P. Morgan

*Attorney, Agent, or Firm*—Sughrue, Mion, Zinn, Macpeak & Seas

[57] ABSTRACT

An apparatus for surface treatment of polishing cloth includes a rotary cloth mounting section on which a polishing cloth is to be attached, and a rotary surface treatment tool made of an inorganic material other than metal and having at least a protrusion with an irregular surface portion on the surface thereof. The surface treatment tool and the cloth mounting section is rotated and a position of a rotation axis of a first rotating unit is different from that of a rotation axis of a second rotating unit. The rotating surface treatment tool is pressed against the cloth mounting section with a predetermined pressure while the surface treatment and cloth mounting sections are rotated.

24 Claims, 7 Drawing Sheets

Fig. 5A
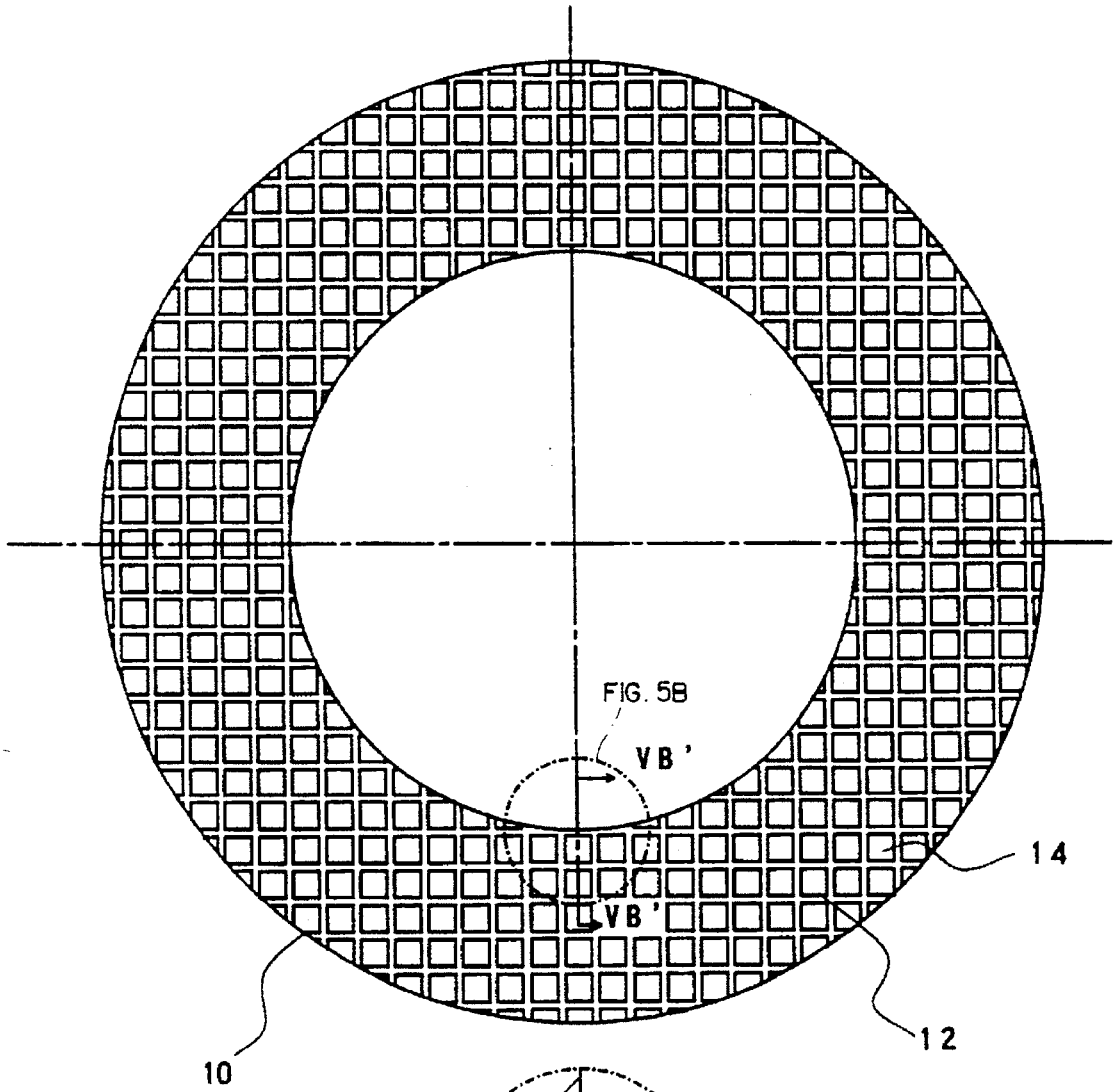
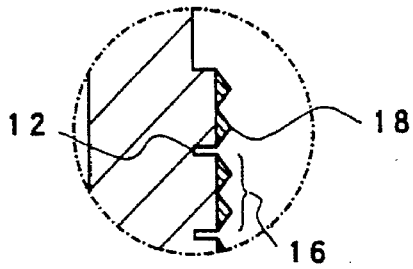
Fig. 5B

Fig. 6A
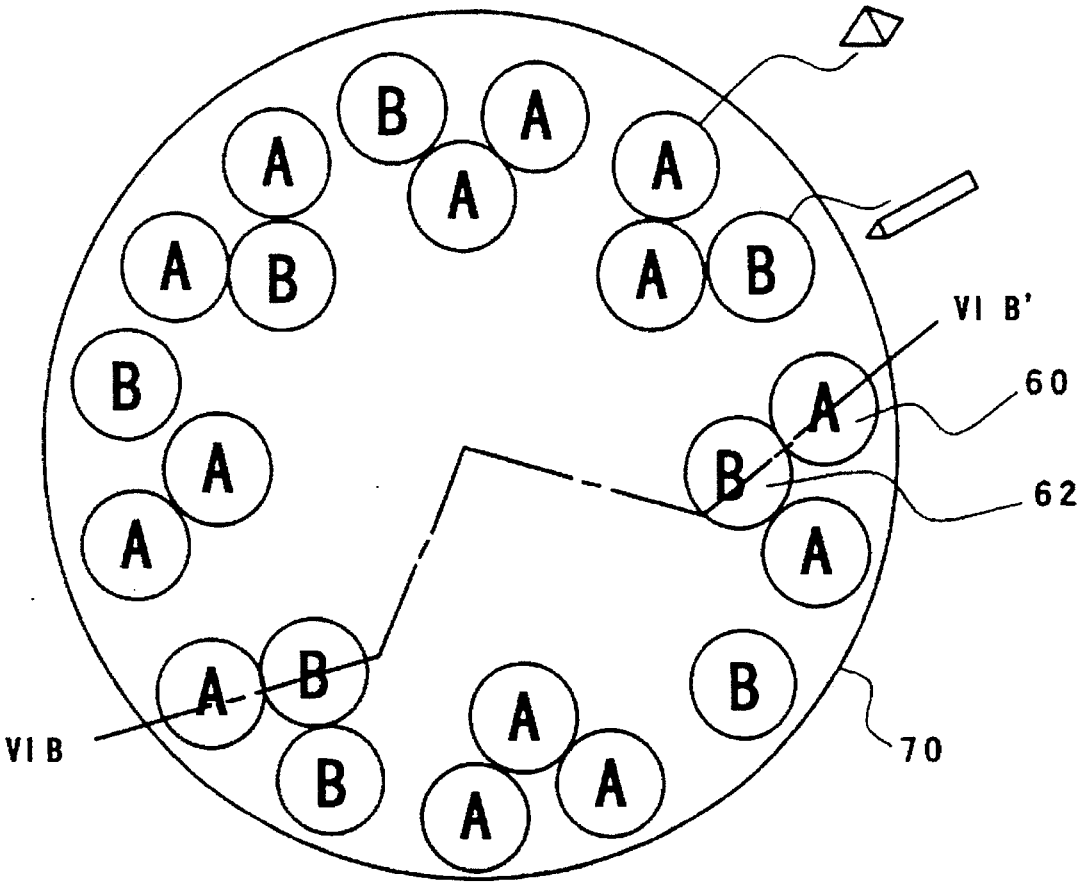
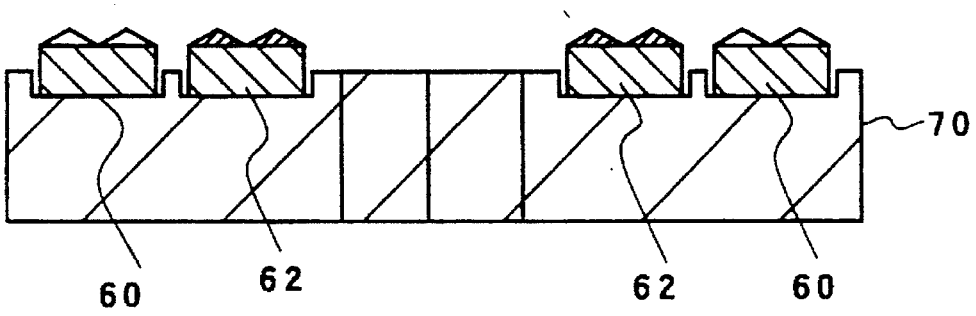
Fig. 6B

SURFACE TREATMENT OF POLISHING CLOTH

BACKGROUND OF THE INVENTION

1. Field of the Invention

The present invention relates to a polishing technique for flattening the surface of a semiconductor device, and more particularly to surface treatment or conditioning of a polishing cloth used for flattening the surface of a semiconductor device.

2. Description of Related Art

In order to form a semiconductor integrated circuit device having a multilayer structure in which wiring layers are arranged in a three dimensional manner, it is necessary to flatten the surface of an interlayer insulating film such as a silicon oxide film between the wiring layers. More specifically, if a silicon oxide film is deposited on a first alminium wiring layer as a bottom layer by a CVD method, an irregular portion would appear on the surface of the silicon oxide film due to the first wiring layer. In this state, if a second aluminium wiring layer is formed on the surface of the silicon oxide film by use of a photolithography process and a dry etching process, a focus cannot be maintained on the surface in the vicinity of the irregular portion in the patterning of a resist layer, or a step portion between the irregular portion and the other portions remains after the dry etching process. For this reason, the irregular portion on the surface of an interlayer insulating film should be flattened, as disclosed in the Japanese Laid-Open Patent Disclosure (JP-A-Hei5-315308). That is, a type of process solution containing a polishing agent is dropped on a polishing cloth provided on a rotating surface table and the irregular portion on the surface of the interlayer insulating film is pushed against the polishing cloth and thereby the irregular portion is removed. The polishing of the silicon oxide film proceeds based on a chemical etching action to the silicon oxide film and a mechanical action such as abrasion of the silicon oxide film by particles of the polishing agent. For this purpose, a process solution is used in which silica particles having a particle size as great as 20 nm are dispersed into an ammonia solution as the polishing agent, wherein the particles comprise about 10 to 30 wt %, as disclosed in the Japanese Laid-Open Patent Disclosure (JP-A-Hei4-75338).

The polishing cloth needs to have hard and flat surface properties in order for it to be used to remove a small surface irregular portion. As such a polishing cloth, there is used a fiber type of polishing cloth such as a polyurethane-impregnated polyester fiber cloth in which synthetic fiber is hardened, or a foam type of polishing cloth such as urethane foam in which polymer is foamed.

In the fiber type of polishing cloth, there is a small space between fibers and the small space extends in a channel manner throughout the whole polishing cloth. Thus, the silica particles contained in the process solution and shavings from the interlayer insulating film are exhausted from the peripheral portion of the polishing cloth through the space channels. Therefore, the polishing cloth is less likely to be binded on the surface. However, the fiber type of polishing cloth has a reduced hardness because of the space channel and is not very adaptive.

On the other hand, in the foam type of polishing cloth, if the density of spherical bores formed through foaming is varied, the hardness of the polishing cloth can be varied, thus resulting in an adaptive polishing cloth. However, polishing particles (silica particles) and shavings often remain in the bores existing in the vicinity of the surface of polishing cloth when a plurality of semiconductor substrates are continuously polished. Therefore, there is the drawback that scratches are caused on the surface of an interlayer insulating film, or the polishing process speed for the insulating film is decreased.

In order to avoid the binding of the foam type of polishing cloth, a polishing cloth surface conditioning process needs to be performed, i.e., a process of cutting an extremely thin surface layer of the polishing cloth for every polishing process needs to be performed to expose the non-binded surface of the polishing cloth. In a conventional conditioning or surface-treating process, a diamond-electrodeposited layer 110, in which diamond particles 16 having the grain size in the range 1 to 100 μm is electrodeposited on a circular stainless plate 120, is rotated as shown in FIG. 1A and pushed against the foam type of polishing cloth which is rotated while pure water or process solution is flowed thereon. When a tool using the electrodeposited diamond particles is pushed against the rotating polishing cloth, as in the conventional polishing cloth surface treatment process, there is a problem in that some of the diamond particles drop and become buried in the polishing cloth so that scratches are caused on the interlayer insulating film surface because of the dropped diamond particles. Also, there is another problem in that the polishing cloth is polluted with metal because the diamond particles are electrodeposited on the metal plate such as stainless plate. Ni is used for electrodeposition of the diamond particles to the stainless plate and, if a diamond particle drops, Ni dissolves into the process solution, resulting in pollution of a semiconductor substrate. The semiconductor substrate is also polluted because of dissolving or peeling of metal such as Ni from the side wall of the stainless plate because the diamond particles are electrodeposited on the undersuface of the stainless plate.

SUMMARY OF THE INVENTION

Therefore, a first object of the present invention is to provide a novel method and apparatus for surface treatment of a polishing cloth.

A second object of the present invention is a method and apparatus for surface treatment of a polishing cloth such that a semiconductor substrate is not polluted with metal and the polishing cloth does not cause scratches on the surface of the semiconductor substrate.

A third object of the present invention is to provide a method and an apparatus for surface treatment of a polishing cloth in which the polishing cloth is uniformly conditioned.

In order to achieve one or more objects of the present invention, an apparatus for surface treatment of polishing cloth according to present invention includes a rotary cloth mounting section on which a polishing cloth is to be attached, a rotary surface treatment tool made of a material other than metal and having at least a protrusion with an irregular surface portion on the surface thereof, first rotating means for rotating the cloth mounting section, second rotating means for rotating the surface treatment tool, a position of a rotation axis of the first rotating means being different from that of a rotation axis of the second rotating means, and pressing means for pressing the rotating surface treatment tool against the cloth mounting section with a predetermined pressure while the surface treatment and cloth mounting sections are rotated.

According to the present invention, the conditioning or surface treatment of the polishing cloth is not performed using an assembly of particles having corners such as electrodeposited diamond particles but using a hard material plate or bulk such as quartz or sapphire having an irregular portion formed on at least one protrusion surface. As a result of this, any hard particle does not drop on the polishing cloth. Therefore, even if polishing is performed to an interlayer insulating film immediately after the conditioning, any scratch is not caused. Also, since the hard inorganic material plate is pushed against the polishing cloth, the polishing cloth is not polluted with metal as a matter of course.

In addition, by rotating the hard inorganic material plate at the same rotation speed as that of the surface table, the relative speed of the inorganic material plate to the polishing cloth can be constant not depending a location in the plane of the inorganic material plate. Since the rotation axis has a degree of freedom such that the plane of the inorganic material plate can be always parallel to the plane of the polishing cloth, the surface treatment can be performed uniformly over the entire of polishing cloth, resulting in increasing uniformity of processing the interlayer film.

Further, when a process solution is supplied from the center portion of the inorganic material plate upon the conditioning, silica particles or shavings attached to the surface of the polishing cloth are flowed out of the inorganic material plate quickly. Therefore, the polishing cloth can be conditioned effectively.

Furthermore, since the grooves are formed on the surface of the inorganic material plate, rinsing water is sufficiently supplied to the entire of polishing cloth through the grooves. Therefore, the time required to externally exhaust shavings and silica particles can be shortened, compared to a plate having no groove. As a result, the time required for the conditioning can be also shortened. It should be noted that the conditioning can be sufficiently performed if the inorganic material plate has an irregular portion on the surface even when the inorganic material plate has no groove.

In addition, according to a polishing cloth conditioning apparatus of the present invention, since there is provided a mechanism for rinsing the surface of the inorganic material plate immediately after the conditioning, shavings or silica particles can be prevented from being adhered to the inorganic material plate and the capability of the inorganic material plate for the polishing cloth surface treatment can be prevented from being degraded as the number of times of the treatment process is increased.

BRIEF DESCRIPTION OF THE DRAWINGS

FIG. 5A is a top plan view of a still further another surface treatment tool in which a recess portion is formed on the center of surface treatment tool and FIG. 5B is a partial cross sectional view of the surface treatment tool shown in FIG. 5A;

FIG. 6 is a top plan view of the surface treatment tool used in the surface-treating apparatus according to a second embodiment of the present invention and FIG. 6B is a partial cross sectional view of the surface treatment tool shown in FIG. 6A.

DESCRIPTION OF THE PREFERRED EMBODIMENTS

The present invention will be described below in detail with reference to the accompanying drawings.

Figure 1A:
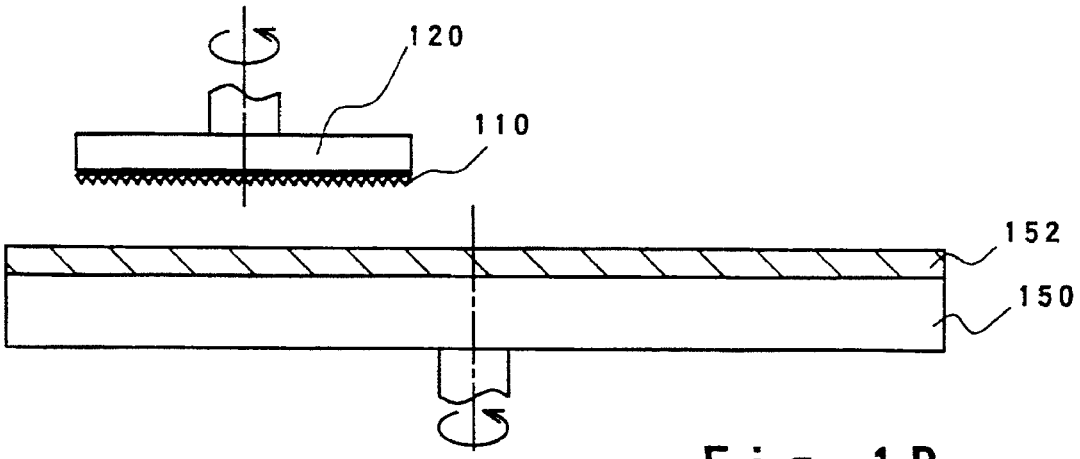
Fig. 1A PRIOR ART
FIG. 1A is a diagram showing a conventional diamond tool in which diamond particles are electrodeposited on a stainless plate and FIG. 1B is a diagram showing a state in which the diamond tool is used to condition a polishing cloth.
Figure 1B:
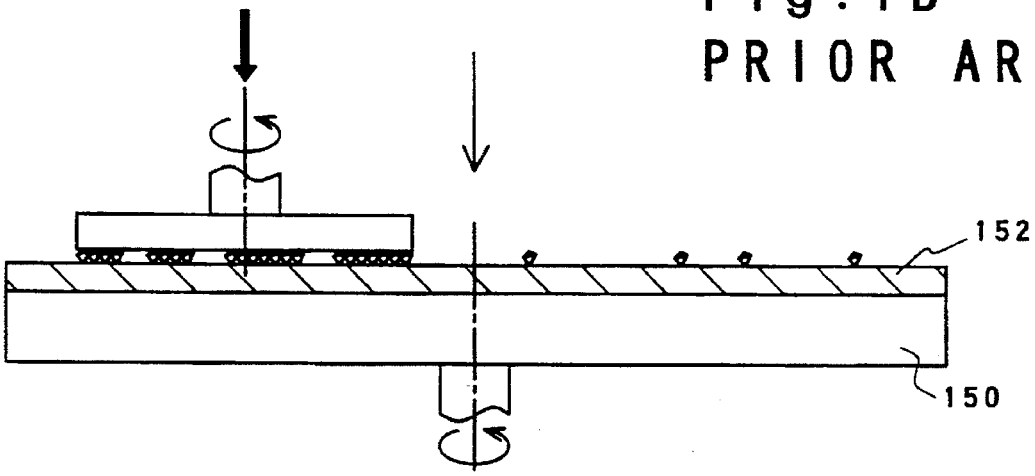
Fig. 1B PRIOR ART
Figure 2:
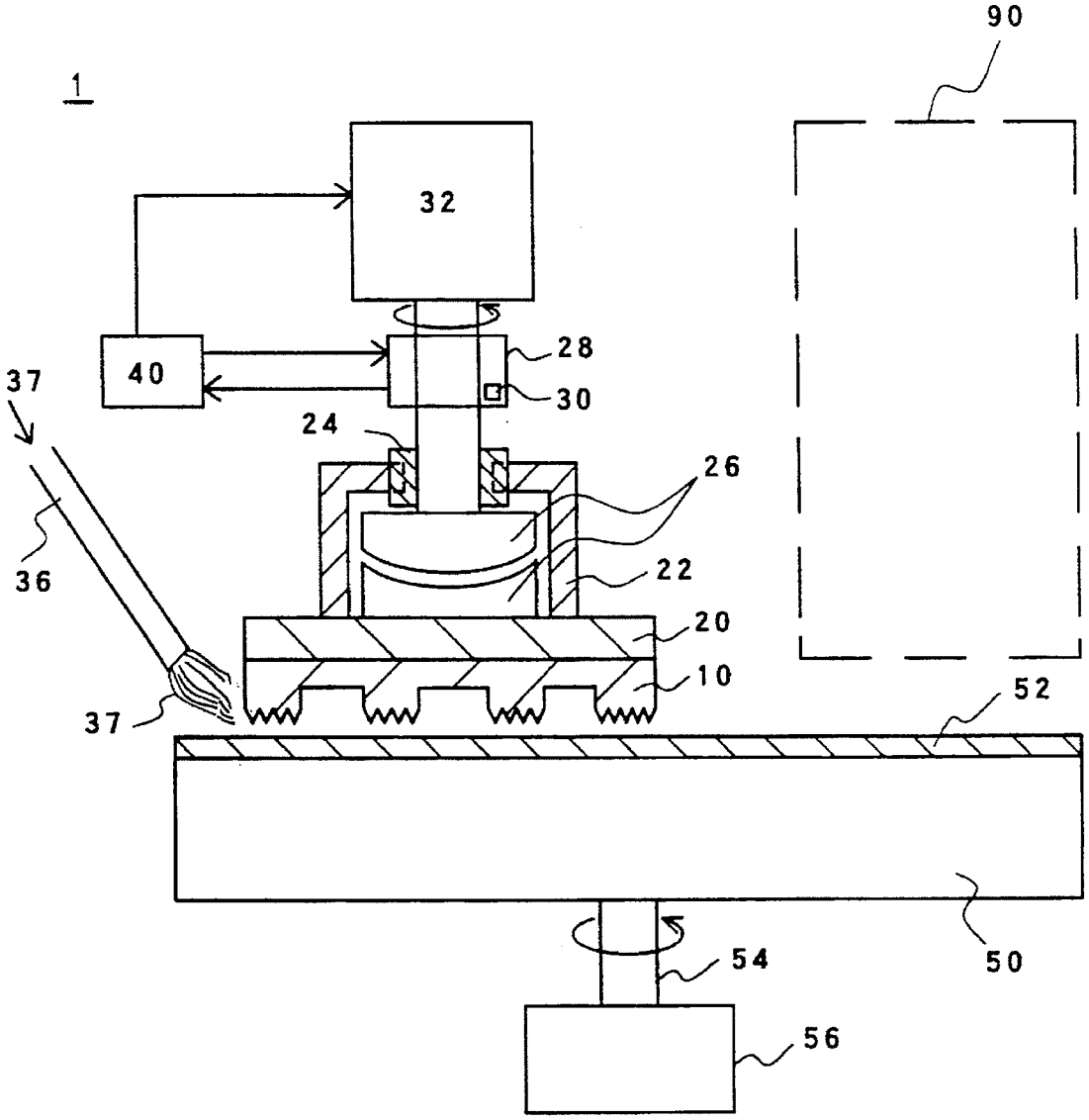
FIG. 2 is a diagram showing a polishing-cloth surface-treating apparatus according to a first embodiment of the present invention.

Referring to FIG. 2, a polishing-cloth surface-treating apparatus 1 according to the first embodiment of the present invention will described below. The surface-treating apparatus 1 mainly includes a rotary surface treatment tool 10 and a rotary surface table 50 on which a polishing cloth 52 is located or mounted. The surface treatment tool 10 and the surface table 50 are pushed against each other with a predetermined pressure while rotating. More particularly, the polishing-cloth surface-treating apparatus 1 includes a motor 32 for rotating the surface treatment tool 10, a pressing unit 28 with a pressure detector 30 provided in the rotation axis from the motor 32, for pressing the surface treatment tool 10 against the polishing cloth 52 with a predetermined pressure, and a control unit 40 for driving the motor 32 to rotate and the pressing unit 28 to activate in accordance with the output from the pressure detector 30. The surface-treating apparatus further includes a quartz plate as the surface treatment tool 10, a rotary base 20 to which the quartz plate 10 is mounted on the lower surface, and a transfer section 26 provided on the upper surface of the rotary base 20 for transferring the pressure from the pressing unit 28. The surface-treating apparatus further includes L-shaped stainless plates 22 connected to the upper surface of the rotary base 20, a flexible joint 24 for flexibly coupling the L-shaped plates 22 to the rotation axis of the motor 32, and for transferring the rotation of the axis of the motor to the rotary base 20, and a process solution supply section 37 for supplying pure water containing abrasive agent particles such as silica particles as a process solution to the contact surface of the surface treatment tool 10 and the polishing cloth 52 and pure water containing no abrasive agent after the surface treatment to rinse the polishing cloth 52 such that the cloth 52 can be used immediately. The surface-treating apparatus 1 further includes the surface table 50 on which the polishing cloth 52 is attached and a motor 56 for rotating the surface table 50.

A unit 90 shown by a dotted line is a unit for holding a semiconductor substrate and polishing the surface of the substrate by use of the polishing cloth 52.

Figure 3A:
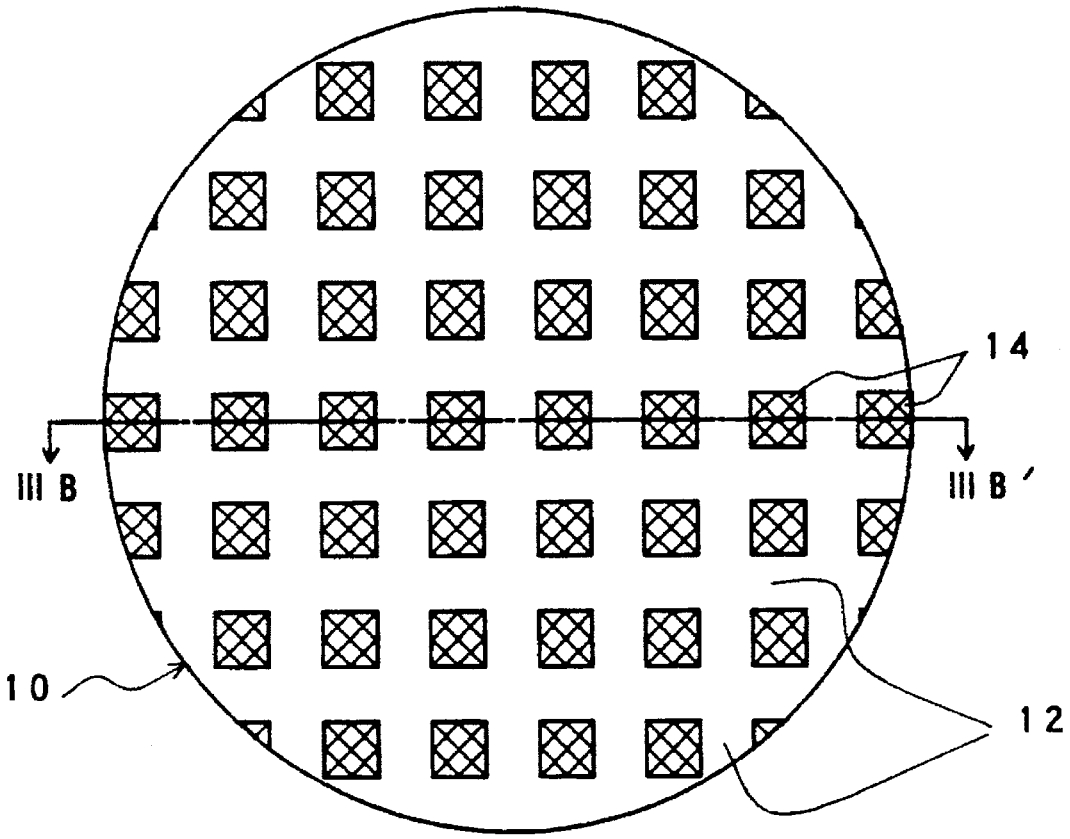
FIG. 3A is a diagram showing a surface treatment tool used in the polishing cloth surface-treating apparatus of the first embodiment in which protrusions are formed entirely.
Figure 3B:
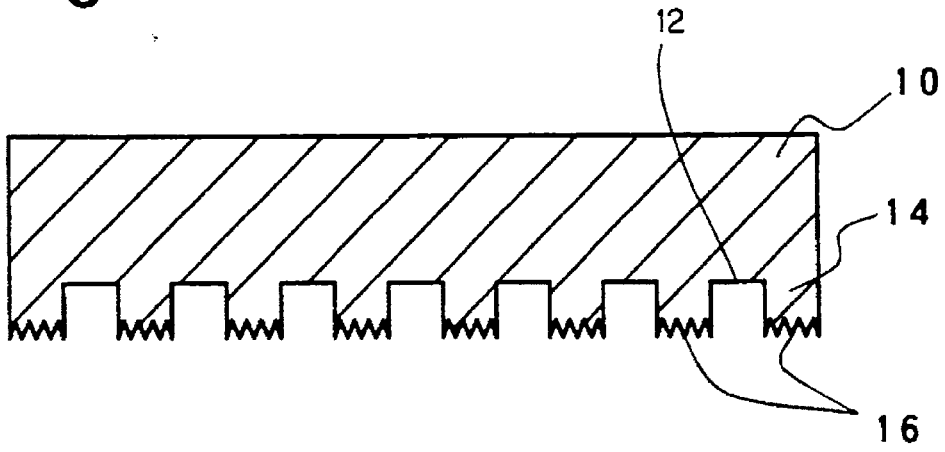
FIG. 3B is a cross sectional view of the surface treatment tool shown in FIG. 3A.

FIGS. 3A and 3B show a top plan view and a cross sectional view of the circular surface treatment tool 10 made of quartz plate 10 of high purity for surface-treating the polishing cloth, respectively. The material of the conditioning tool 10 may be a hard inorganic material having a hardness at least equal to or harder than the abrasive agent particles contained in the process solution. When silica particles are used as abrasive agent, a sapphire plate, a diamond plate, silicon carbide or alumina sintered plate may be used as a surface-treating tool other than the quartz plate. The quartz plate 10 has a protrusion section comprising a plurality of protrusions 14 arranged in a matrix manner. In other words, a groove section including many grooves 12 is formed thereon in a lattice manner. The diameter of the circular quartz plate 10 is specifically not limited, but it is desirably equal to or smaller than the radius of the rotary surface table 50. For instance, in a case that the diameter of the rotary surface table 50 is 480 mmΦ, the diameter of the quartz plate 10 is desirably about 230 mmΦ. The thickness of the quartz plate 10 is 30–40 mm to be sufficient in mechanical strength. The pitch between the grooves 12 and the width of the groove 12 are not limited, but are desirably 10–20 mm in pitch and 1 to 10 mm in width, respectively. An irregular portion 16 having projections of a small height is formed on the surface of each of the protrusions 14. The height of each projection is about 0.5–3 mm. The shape of projection is of a rectangular cone type or of a sawtooth-like cross section type. A various shapes of projections may be present on the same protrusion 14.

Next, the method of producing the quartz plate 10 will be described below. First a region corresponding to the irregular portions 16 is formed on the quartz plate 10 and then the grooves 12 are formed. More specifically, in order to form the irregular portions 16 the surface of the quartz plate 10 are cut out with a diamond cutter of a V-like shape. The depth of the cutting is about 0.5–3 mm and the width thereof is about 2–5 mm at the surface of the quartz plate 10. The quartz plate surface is cut out in lateral and longitudinal directions in a lattice manner so that small projections of a rectangular cone (pyramid) type are formed. If the quartz plate surface is cut out with the diamond cutter only in parallel and lateral directions, projections having a cross section of sawtooth-like shape could be formed as the irregular portion 16. If the diamond cutter is operated such that it is moved in two directions in a region of the quartz plate 10 and in one direction in a part of the region, there can be obtained an irregular portion 16 in which rectangular cone type projections and sawtooth-like shape type projections are mixedly present. Further, if the surface of the quartz plate 10 is not cut with the diamond cutter, a protrusion having a flat surface can remain.

Subsequently, the grooves 12 of about 3–10 mm in depth and about 1–10 mm in width are formed on the quartz plate surface 10 with a pitch of about 10–20 mm by use of a normal diamond cutter, so that portions other than the grooves 12 remain as the protrusions 14 having the irregular portion 16 of small projections.

If the protrusions having the flat surface are scatteredly provided on the quartz plate 10 surface, when a part of a surface layer of a polishing cloth is cut or abraded so that the surface of the polishing cloth becomes nappy, the protrusions having the flat surface falls down the naps to be plan, although the ratio of the protrusions having the irregular portion to the protrusions having the flat surface needs to be adjusted depending upon the properties of the polishing cloth. In a case of a harder foam type of polishing cloth, the entire surface of all the protrusions of the quartz plate 10 may have an irregular portion 16 of a rectangular cone type or a sawtooth type.

Next, the operation of the surface-treating apparatus will be described below. As shown in FIG. 2, the polishing cloth 52 is attached to the surface table 50 and the quartz plate 10 is fixed to the stainless plate 20 by screws from a stainless plate side to prevent metal pollution. Then, the motors 32 and 56 are rotated under control of the control unit 40. The circular stainless plate 20 is fixed with L-shaped stainless plates 22. A U-shaped stainless joint 24 is attached to the side wall of a rotation axis of the motor 32 to flexibly sandwich the L-shaped stainless plates 22. Thus, when the motor 32 rotates, the circular plate 20 and quartz plate 10 rotate via the L-shaped stainless plates 22 sandwiched by the U-shaped stainless joint 24. The joint 24 has a flexible structure, therefor even if a part of the quartz plate 10 moves up and down to be inclined, the joint 24 can transfer the rotation of the motor axis to the L-shaped plates 22. It is desirable that the rotation speed of the quartz plate 10 is the same as that of the polishing cloth 52 (on the polishing surface table 50) and is about 20 to 100 rpm, for example. However, it may be set such that it is different from the rotation speed of the polishing cloth.

Then pure water or pure water containing a polishing agent is supplied as a process solution to the surface of the polishing cloth 52 from the supply section 36 with a flow rate of about 100 to 500 ml/min. Subsequently, the control unit 40 controls the pressing unit 28 to apply a predetermined pressure to the quartz plate 10 via the rotation axis of the motor 32 while checking the detection result of the detector 30. As a result, the quartz plate 10 is pushed against the polishing cloth 52. A semi-spherical recess section of the transfer section 26 is fixed to the stainless plate 20 and a semi-spherical protruding section of the section 26 is fixed to the rotation axis of the motor 32. Therefore, the surface treating apparatus has a degree of freedom with which the plane of the surface treatment tool 10 can follow to be always parallel to the surface of the polishing cloth 52. The pressure to be applied from the quartz plate 10 to the polishing cloth 52 is dependent upon the height and density of projections in the small irregular portion 16 formed on the surface of quartz plate and is about 0.005 to 0.5 $Kg/cm^2$. Thus, the quartz plate 10 is pressed to the rotating polishing cloth 52 while rotating. At this time, the grooves 12 formed on the quartz plate are used as paths for flowing the pure water. By this, silica particles attached to a part of the surface layer and the surface of the polishing cloth 52 and shavings accumulated in bores in the polishing cloth 52 can be exhausted or removed. When there is no groove on the quartz plate, it is difficult to pull the quartz plate away from the polishing cloth after the surface treatment or conditioning due to the surface tension of water which acts between the quartz plate and the polishing cloth. However, the surface tension of water does not act strongly because of presence of the grooves 12.

Then, after the surface of polishing cloth 52 is rinsed, a unit 90 shown by a dot line starts to work. A semiconductor substrate is held in the unit 90 and pressed against the polishing cloth 52 while rotating, to flatten the surface of the interlayer insulating film.

In this manner, according to the polishing-cloth surface-treating apparatus of the present invention the polishing cloth is conditioned to eliminate the binding state. Therefore, even in a case that a foam type of polishing cloth is used, there is no case where the polishing process speed for the interlayer insulating film is degraded as the use time of the polishing cloth. Further, any scratch as seen when a conventional diamond electrodeposited tool is used is not seen in the surface-treating apparatus according to the present invention. In addition, there is no pollution with metal as a matter of course.

In the above embodiment, a pattern of grooves is formed on the quartz plate in a lattice manner. The pattern of grooves may be a combination of a concentric patten of grooves and a radial direction pattern of grooves, only a radial direction pattern of grooves, an eddy pattern of grooves, or a random pattern of grooves. In either of patterns the desired effect can be obtained.

Figure 4A:
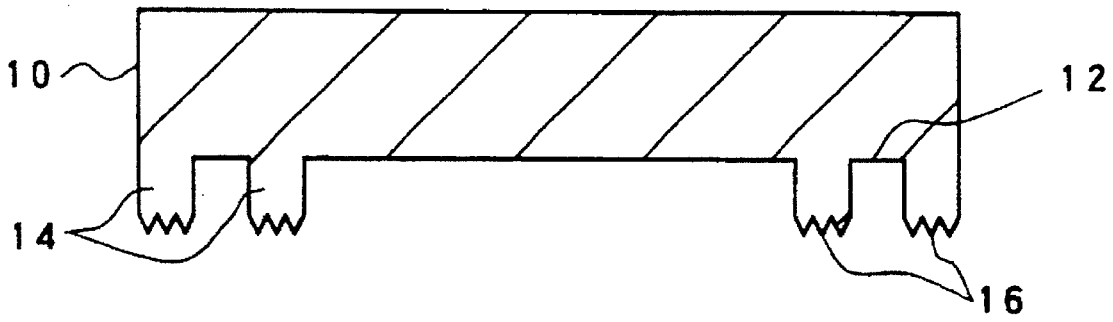
FIG. 4A is a cross sectional view of the another surface treatment tool and FIG. 4B is a cross sectional view of further another surface treatment tool.
Figure 4B:
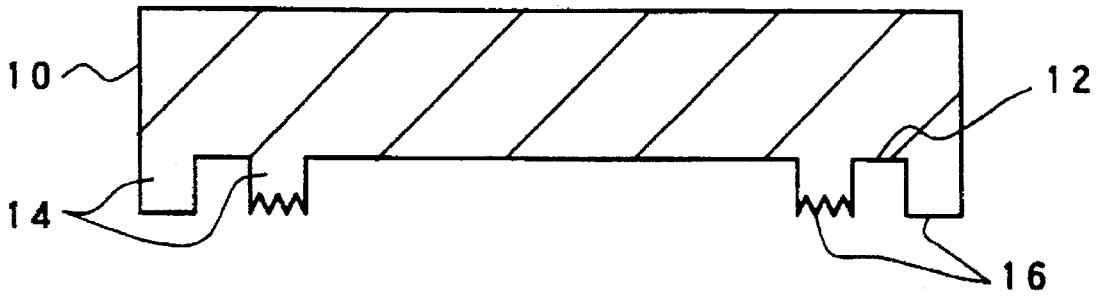

FIGS. 4A and 4B are diagrams showing other examples of a quartz plate as a conditioning tool. The protrusion section may be formed only in an outer peripheral portion of the quartz plate surface 10 as shown in FIG. 4A or 4B. In this case, each protrusion 14 may have an irregular portion of a small height projections or a flat surface without any projection.

FIG. 5A and 5B are diagrams showing another embodiment of a quartz plate 10 as a conditioning tool used to condition a polishing cloth of 470 mmΦ. In this example, the diameter of the tool is 230 mm. First, the inner regular portion of 140 mmΦ of the quartz plate 10 having the diameter of 230 mmΦ and thickness of 40 mm is cut out with depth of 5 mm. Then, a V-shaped cutter is used to form an irregular portion 16 on the surface of the quartz plate such that each of projections of the irregular portion 16 is of a rectangular cone type. The rectangular cone type of projection has a height of 2 mm and a width of 3.3 mm. Subsequently grooves 12 of 5 mm in deep and 1 mm in wide are formed in a lattice manner. Through these steps, the irregular region 16 (having rectangular cone type of projections in this example) and the grooves as a drainage channel are formed in the peripheral region of the quartz plate. In a case in which a quartz plate having such a large diameter is used, if the protrusion section is provided at the periphery of the quartz plate 10, the effect of the drainage channel grooves is less. Thus, the groove is not always necessary.

FIGS. 6A and 6B are diagrams showing another embodiment of surface-treating tool using sapphire according to another embodiment of the present invention. The sapphire is harder than quartz and is a desirable material for the conditioning tool. However, it is very expensive. Therefore, a sapphire plate having a small diameter, for example, a diameter of 20 to 30 mmΦ, a thickness of 5 to 10 mm and an irregular portion comprising projections having a triangular cone shape, a quadrangular cone shape or a sawtooth-like shape is formed on the surface of the sapphire plate. A plurality of small diameter sapphire plates each thus formed are pasted on a quartz plate or a glass plate having a large diameter, for example, of 230 mmΦ. In this case, since there is a space between adjacent sapphire plates having a small diameter, it is not necessary to form a groove for the drainage channel on the quartz plate as a base. In this example, two types of sapphire plates, i.e., the sapphire plates 60 with an irregular portion having quadrangular-cone-shaped projections (sapphire plates A in the figure) and the sapphire plates 62 with an irregular portion having sawtooth-like cross section (sapphire plates B in the figure) are pasted on the quartz or glass plate. Specifically, the longitudinal direction of the sawtooth like projections is directed toward the center of the quartz plate. That is, the ridge of the sawtooth like irregular portion is set to match a radial direction or a direction near to the radial direction. In this configuration, each of the quadrangular cone like projections 18 contacts the polishing cloth at a point to roughly cut the surface of the polishing cloth and a sawtooth like irregular portion contacts the polishing cloth at a line to finishingly cut the polishing cloth. The number of sapphire plates having the quadrangular cone like irregular portions is set to be more for a hard polishing cloth such as a polyurethane foam and the number of sapphire plates having the sawtooth like irregular portions is set to be more for a soft polishing cloth such as a fiber type of polyester. All the sapphire plates may have the quadrangular cone like irregular portion or the sawtooth like irregular portion. The shape of small sapphire plate may be circular, quadrangular or polygonal. The sapphire plates may be pasted over the entire surface of the quartz plate as a base.

The irregular portion may be formed on the surface of the sapphire plate after the sapphire plate is pasted on the surface of the quartz plate. In this case, since the sapphire plate is cut after being pasted on the quartz plate, the amount of protrusion of each of the sapphire plates pasted can be constant. Also, there is an advantage in that a peak position of the projection of the irregular portion can be easily determined in the quartz plate having a large diameter because the irregular portion is formed on the surface of the sapphire plate in the step subsequent to the pasting step. The sapphire plates may be pasted on the quartz plate without cutting a part of the surface of the quartz plate.

Figure 7:
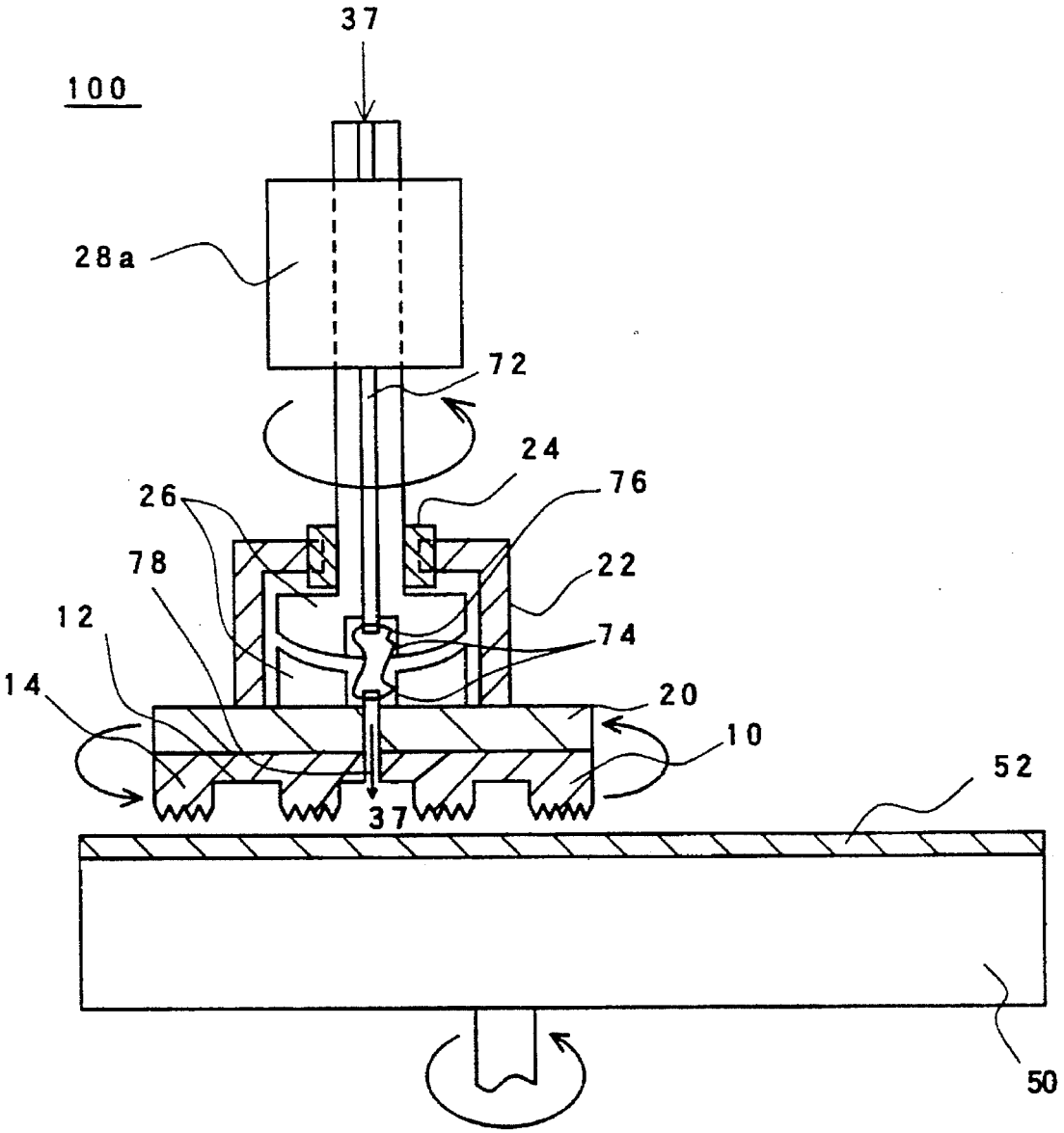
FIG. 7 is a diagram showing a polishing-cloth surface-treating apparatus according to a third embodiment of the present invention.

FIG. 7 is a diagram showing another embodiment in which pure water or pure water containing abrasive agent particles such as silica particles is supplied as process solution from the center portion of the quartz plate 10 in the polishing cloth surface treatment. The pure water flows to the center portion 78 of the quartz plate 10 through the inside of the rotation axis of the motor 32 and a flexible tube 76 provided in recess portions 74 of the semispherical transfer section 26. In a case of such a mechanism, since the pure water flows always in an outerward direction, exhaustion of the silica particles attached to the surface layer of the polishing cloth and shavings accumulated in bores is promoted and as a result of this the conditioning process can be performed more uniformly.

In the above-mentioned embodiment, pure water is used as a process solution in the conditioning. However, another process solution may be used which does not corrode the quartz plate. For instance, electrolysis ionized water may be used which has a high particle removability (Symposium on VLSI Technology Digest of Technical of Technical Paper pp. 107–108, and pp. 79–80, 1993). This electrolysis ionized water can be obtained by applying a DC voltage between an anode electrode and a cathode electrode which are provided in a continuous supply type of electrolysis ionized water production apparatus perform electrolysis of water. Through electrolysis, $H^+$ ions are attracted to the cathode electrode to emit electrons to the cathode electrode so that $H_2$ gas is generated. As a result, $OH^-$ ions are remained much and water in the vicinity of the cathode electrode is indicative of a weak alkaline. Similarly, since oxygen gas is generated so that $OH^-$ ions are decreased, the water in the vicinity of the anode electrode is indicative of an acid.

In a case in which the weak alkaline ionized water is used as a cathode water on the reduction side of the oxidation-reduction potential of −800 mV, $OH^-$ radicals are adsorbed on the surface of polishing cloth and on the abrasive agent particles so that the surfaces of the polishing cloth and abrasive agent particles are charged negatively. As a result, silica particles attached to the polishing cloth can be readily taken out. Therefore, the surface treatment of the polishing cloth can be further effectively performed by utilizing this effect and the mechanical effect of the surface treating tool.

Diluent ammonia solution, ammonium acetate solution, or a weak alkaline solution obtained by adding a chemical such as amine solution to pure water may be used to make $OH^-$ radicals become adsorbed on the surfaces of polishing cloth and silica particles. In this case, the same effect can be obtained. However, cost increases because it is necessary to remove the chemical additive from the surface treatment wasted solution. When alumina particles are used as the abrasive agent, anode ionized water or acid solution in which diluent nitric acid or the like is added may be used to make $H^+$ radicals become adsorbed on the polishing cloth and alumina particles for the surface treatment or conditioning. Further, weak acid solution such as carbonic acid solution, diluent hydrochloric acid solution, diluent sulfuric acid solution, or diluent nitric solution may be used.

It should be noted that although alumina sintered polycrystalline plate may be used as material of an inorganic plate, it is necessary for alumina sintered particles to be gathered rigidly in such a manner that the particles do not drop out of the polycrystalline plate.

According to the present invention, the surface treating tool comprising an inorganic plate having a hardness equal to or harder than that of abrasive agent particles contained in the process solution is pushed against the polishing cloth to eliminate the binding state of the polishing cloth. Therefore, the interlayer insulating film can be flattened without any scratch and metal pollution. Also, in a case of using a hard foam type of polishing cloth, the polishing process speed of an interlayer insulating film does not decrease. Therefore the yield and process time of the flattening process can be remarkably improved and as a result of this the manufacturing cost of a semiconductor device can be reduced greatly.

What is claimed is:

1. An apparatus for surface treatment of a polishing cloth, comprising:

a rotary cloth mounting section on which a polishing cloth is attached;

a rotary surface treatment tool comprised of a base member made of a material other than metal and having a plurality of protrusions formed integrally thereon by grooves cut in said rotary surface treatment tool, each of said protrusions having an irregular surface;

first rotating means for rotating said cloth mounting section;

second rotating means for rotating said rotary surface treatment tool, a position of a rotation axis of said first rotating means being different from that of a rotation axis of said second rotating means; and pressing means for pressing said rotary surface treatment tool against said cloth mounting section with a predetermined pressure while said rotary surface treatment tool and cloth mounting section are rotated.

2. An apparatus for surface treatment according to claim 1, wherein said protrusion is made of a material having a predetermined hardness.

3. An apparatus for surface treatment according to claim 2, wherein said protrusion is made of a material selected from the group of quartz, sapphire, silicon carbide and alumina sintered body.

4. An apparatus for surface treatment according to claim 1, wherein a plurality of said protrusions are formed only in a peripheral portion of the surface of said rotary surface treatment tool.

5. An apparatus for surface treatment according to claim 1, wherein said rotary surface treatment tool further includes at least one protrusion having a flat surface.

6. An apparatus for surface treatment according to claim 1, further comprising supply means for supplying a process solution containing an abrasive agent to an interface of said surface treatment tool and said polishing cloth.

7. An apparatus for surface treatment according to claim 6, wherein said process solution is electrolysis ionized water or pure water.

8. An apparatus for surface treatment according to claim 6, wherein said supply means extends through the center of said rotary surface treatment tool.

9. An apparatus for surface treatment according to claim 1, said pressing means includes means for pressing said rotary surface treatment tool against said polishing cloth such that said rotary surface treatment tool contacts said polishing cloth in parallel to each other.

10. An apparatus for surface treatment according to claim 1, wherein said second rotating means further includes a flexible joint for maintaining said rotary surface treatment tool in parallel with said polishing cloth.

11. An apparatus for surface treatment according to claim 1, wherein a rotation speed of said rotary surface treatment tool is substantially equal to that of said cloth mounting section.

12. An apparatus for surface treatment of a polishing cloth, comprising:

a rotary mounting section on which said polishing cloth is attached;

a rotary surface treatment section including a surface treatment tool comprised of a base member made of a material other than metal and having a plurality of protrusions formed integrally thereon by grooves cut in a surface of said surface treatment tool, each of said protrusions having an irregular surface;

supply means for supplying a process solution containing an abrasive agent to an interface of said surface treatment tool and said polishing cloth to remove shavings from said polishing cloth; and driving means for rotating said rotary mounting section and said rotary surface treatment section.

13. An apparatus for surface treatment according to claim 12, wherein said surface treatment tool is made of a material having a hardness equal to or harder than that of the abrasive agent.

14. An apparatus for surface treatment according to claim 13, wherein said surface treatment tool has a recess portion at a center portion thereof and said grooves are formed in a peripheral portion of said surface treatment tool.

15. An apparatus for surface treatment according to claim 12, further including means for pressing said surface treatment tool against said polishing cloth such that said surface treatment tool contacts said polishing cloth in parallel to each other.

16. An apparatus for surface treatment of a polishing cloth, comprising:

a rotary mounting section on which said polishing cloth is mounted; and a surface treatment tool comprised of a base member having grooves cut in a surface of said surface treatment tool, a plurality of plates disposed within said grooves respectively, each of said plates protruding from said grooves and having a plurality of irregular surfaces formed integrally thereon;

a first driving means for relatively pushing said rotary mounting section and said surface treatment tool against each other while said rotary mounting section and said surface treatment tool are being rotated by a second driving means such that said surface treatment tool always contacts said rotary mounting section in parallel.

17. An apparatus for surface treatment according to claim 16, wherein said protrusion is made of a material having a hardness equal to or harder than that of an abrasive agent.

18. An apparatus for surface treatment according to claim 17, further comprising supply means for supplying a process solution containing said abrasive agent to an interface of said surface treatment tool and said polishing cloth to remove shavings from said polishing cloth.

19. An apparatus for surface treatment according to claim 16, wherein at least one of said protrusions on said plates is made of sapphire, and said base is made of quartz or glass.

20. An apparatus for surface treatment according to claim 16, wherein said rotary surface treatment tool further includes at least one protrusion having a flat surface.

21. An apparatus for surface treatment according to claim 16, wherein said at least one protrusion has a triangular cross section.

22. An apparatus for surface treatment according to claim 16, wherein some of said plurality of plates have projections having a quadrangular-cone-shaped cross section formed on a surface of said plates and some of said plurality of plates have projections having a sawtooth-shaped cross section formed on a surface of said plates.

23. An apparatus for surface treatment according to claim 22, wherein a number of plates with projections having a quadrangular-cone-shaped cross section is greater than a number of plates with projections having a sawtooth-shaped cross section.

24. An apparatus for surface treatment according to claim 22, wherein a number of plates with projections having a quadrangular-cone-shaped cross section is less than a number of plates with projections having a sawtooth-shaped cross section.

* * * * *